United States Patent [19]

Engel et al.

[11] Patent Number: 5,046,563

[45] Date of Patent: Sep. 10, 1991

[54] APPARATUS AND METHOD FOR CUTTING AN OBJECT IN A WELL

[75] Inventors: William T. Engel, Arlington; Hector A. Tamayo, Ft. Worth, both of Tex.

[73] Assignee: Jet Research Center, Inc., Alvarado, Tex.

[21] Appl. No.: 432,708

[22] Filed: Nov. 7, 1989

[51] Int. Cl.[5] ..... E21B 43/11

[52] U.S. Cl. ..... 166/297; 102/310

[58] Field of Search ..... 166/297, 55.1; 175/4.56; 102/310, 317, 318; 89/1.15

[56] References Cited

U.S. PATENT DOCUMENTS

| | | | |
|---|---|---|---|
| Re. 25,685 | 11/1964 | Griffith et al. | 102/24 |
| 2,935,020 | 5/1960 | Howard et al. | 102/20 |
| 2,984,307 | 5/1961 | Barnes | 175/2 |
| 3,057,295 | 10/1962 | Christopher | 102/20 |
| 3,233,688 | 2/1966 | Bell | 175/4.6 |
| 3,401,632 | 9/1968 | Griffith et al. | 102/24 |
| 4,290,486 | 9/1981 | Regalbuto | 166/297 |
| 4,354,433 | 10/1982 | Owen | 102/307 |
| 4,378,844 | 4/1983 | Parrish et al. | 166/297 |
| 4,753,170 | 6/1988 | Regalbuto et al. | 102/305 |
| 4,850,438 | 7/1989 | Regalbuto | 102/310 X |

*Primary Examiner*—William P. Neuder

*Attorney, Agent, or Firm*—E. Harrison Gilbert, III; James R. Duzan; Thomas R. Weaver

[57] ABSTRACT

A cutting tool to cut a tubular element in a well is constructed of pellets of less sensitive explosive material detonated by a pellet of a more sensitive explosive material. All the explosive material is packaged in individual packages which qualify for a lower cost, faster, safer transportation classification, but which explosive material is consolidated and assembled at a field location into a cutting tool capable of generating a sufficient force to cut the tubular element. A corresponding method is also disclosed.

8 Claims, 1 Drawing Sheet

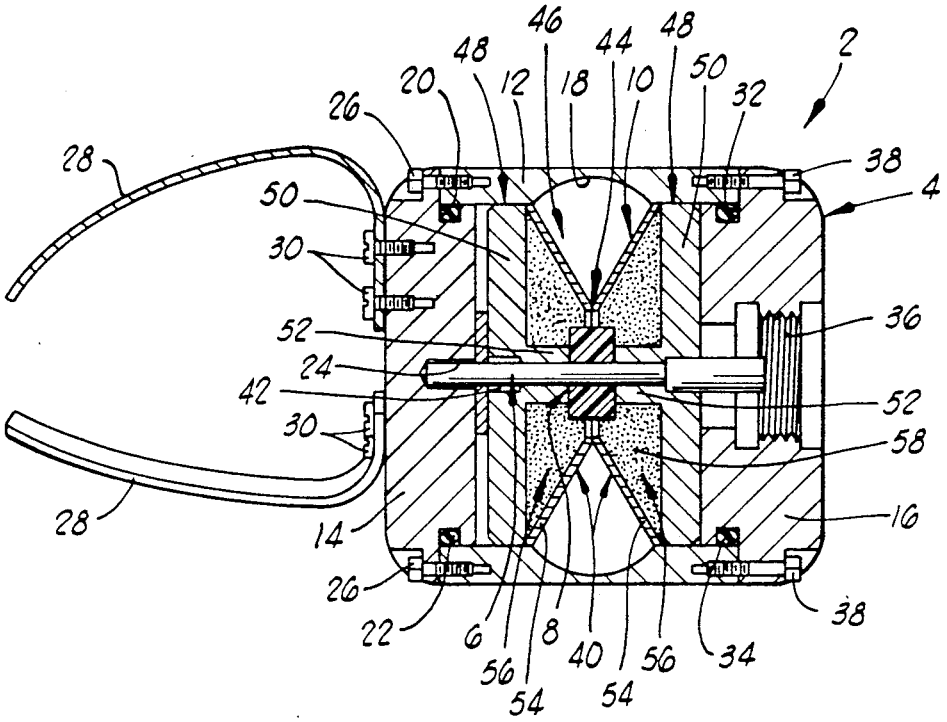
FIGURE "1"

APPARATUS AND METHOD FOR CUTTING AN OBJECT IN A WELL

BACKGROUND OF THE INVENTION

This invention relates generally to apparatus and methods for cutting an object in a well and more particularly, but not by way of limitation, to an apparatus and method for cutting a tubular element in a well with a combination of less sensitive and more sensitive explosives transported in small enough quantities to qualify as class C explosives but consolidated and assembled at a field location to provide an adequate explosive force to cut the tubular element.

Tubular elements, such as drill pipe or casing, or other objects located in an oil or gas well sometimes need to be cut or severed. One type of device for doing this is an explosive cutting tool. Such a tool includes an explosive which, after the tool has been lowered into the well to the location where the cut is to be made, is detonated to provide a cutting force.

Explosive cutting tools used to sever drill pipe, casing or other objects used in oil and gas wells require explosive charges greater than 22.7 grams, the weight limit above which an explosive is categorized as class A material. These large explosive loads impose special safety considerations, result in time delays and must be transported as class A material as defined by pertinent United States regulations. Having to transport such a cutting tool, or the explosive thereof, as class A material imposes additional shipping expense, particularly when the tool or explosive component is to be exported.

It would be desirable to provide an explosive cutting tool which could be shipped in a manner which qualifies for class C status (explosive less than 22.7 grams) because this would permit less expensive, more expediently dispatched transportation. Such a tool should, however, still be capable of use in a well to provide a sufficient explosive force to cut the object as desired.

Such a cutting tool, or the explosive charge of such tool, can be manufactured from a less sensitive material and divided into small shipping quantities to meet class C requirements; however, such less sensitive material alone typically lacks adequate detonation sensitivity, which poses detonation problems and can result in such a tool failing to make the desired cut.

SUMMARY OF THE INVENTION

The present invention overcomes the above-noted and other shortcomings of the prior art by providing a novel and improved apparatus and method for cutting an object in a well. The present invention utilizes small quantities of less sensitive and more sensitive explosives which, at a field location near or at the well site, are consolidated and assembled into a cutting tool which, when detonated, provides an adequate explosive force to cut the desired object in the well.

Advantages of the present invention include less expensive, more expedient, safer transportation while also realizing a more effective and reliable cutting tool and method.

The present invention provides a sensitized cutter for cutting a tubular member in a well, comprising: a support body; a booster fuse retained in the body; a booster explosive transported to a field location detached from within the body and disposed at the field location concentrically about the booster fuse and within the body; and a shaped charge disposed at the field location concentrically about the booster explosive and within the body, the shaped charge weighing more than 22.7 grams and including a plurality of pellets of charge explosive transported to the field location in individual packages detached from within the body and containing less than 22.7 grams of the charge explosive each.

The present invention also provides a method of cutting an object in a well, comprising: transporting a first explosive to a field location in individual quantities which are less than a predetermined limit quantity; transporting a second explosive to the field location in a quantity less than the predetermined limit quantity, which second explosive is a more sensitive explosive than the first explosive; consolidating, at the field location, the individual quantities of first explosive into a shaped charge having a total quantity of the first explosive greater than the predetermined limit; assembling a cutting tool at the field location, including supporting the second explosive adjacent the shaped charge; lowering the cutting tool into the well to an object therein to be cut; and detonating the shaped charge in response to detonating the second explosive so that the detonated shaped charge generates a force which cuts the object.

Therefore, from the foregoing, it is a general object of the present invention to provide a novel and improved apparatus and method for cutting an object in a well. Other and further objects, features and advantages of the present invention will be readily apparent to those skilled in the art when the following description of the preferred embodiment is read in conjunction with the accompanying drawing.

BRIEF DESCRIPTION OF THE DRAWING

FIG. 1 is a drawing of a sectional view of a cutting tool assembled in accordance with the present invention.

DETAILED DESCRIPTION OF THE PREFERRED EMBODIMENT

Referring now to FIG. 1 a cutting tool 2 constructed in accordance with the present invention is shown in the drawing. The tool 2 includes a support body 4, a booster fuse 6, a booster explosive 8 and a shaped charge 10.

The support body 4 includes a cylindrical sleeve 12, a cylindrical end piece 14 and a cylindrical end piece 16.

The cylindrical sleeve 12 has a centrally located internal groove 18 which is aligned with the shaped charge 10 after the tool 2 has been assembled. The groove 18 allows effective use of focusing or directing radially outwardly the explosive force generated when the shaped charge 10 is detonated.

The cylindrical end piece 14 has a circumferential groove 20 for receiving a sealing member 22, such as an O-ring, which seals against the inner surface of the cylindrical sleeve 12. The cylindrical end piece 14 also has an axial cavity 24 for receiving one end of the booster fuse 6. The end piece 14 is attached to one end of the sleeve 12 by four bolts 26 (two shown). Attached to and extending from the end piece 14 is a centralizer comprising in the illustrated embodiment three (two shown) flat metal springs 28, each of which is attached by a respective two bolts or screws 30.

The cylindrical end piece 16 has a circumferential groove 32 for receiving a sealing member 34 which seals against the interior surface of the sleeve 12 at the other end of the sleeve 12. The end piece 16 has an axial threaded opening 36 through which a conventional mechanism for igniting the booster fuse 6 extends (see U.S. Pat. No. 3,057,295 to Christopher, for example). Such mechanism is carried on a connecting member threadedly connected in the opening 36 in a conventional manner. The end piece 16 is connected to the respective end of the sleeve 12 by four bolts 38 (two shown).

The booster fuse 6 is a conventional device (see U.S. Pat. No. 3,057,295 to Christopher, for example). It is supported at one end in the cavity 24, and it is centrally supported by the concentric booster explosive 8.

The booster explosive 8 is an annular pellet of sensitive explosive, such as RDX explosive, which has been transported to the field location, where the tool 2 is to be assembled and used, detached from within the support body 4. At the field location, which can be the well site or the district office or somewhere else relatively close to the well site, the booster explosive 8 is disposed concentrically about the booster fuse 6 and within the body 4 as illustrated in the drawing. The annular pellet defining the preferred embodiment of the booster explosive 8 preferably weighs less than 22.7 grams so that it can be individually packaged and transported as class C material. Once transported to the field location, the annular pellet is then assembled into the tool 2 as described above and shown in the drawing, which assembly also includes concentrically disposing the pellet 8 within the shaped charge 10.

The shaped charge 10 is disposed at the field location concentrically about the booster explosive 8 and within the body 4. The shaped charge 10 of the preferred embodiment weighs more than 22.7 grams and includes a plurality of pellets of charge explosive transported to the field location in individual packages detached from within the body 4 and containing less than 22.7 grams of the charge explosive each so that the individual packages can be transported as class C material.

In the illustrated embodiment, the shaped charge 10 includes two frusto-conical halves 40 having a center hole 42. Flat apexes 44 abut to define an annular shaped charge with a circumferential groove 46 having a V-shaped appearance in cross section as shown in the drawing. The groove 46 adjoins the groove 18. Each of the halves 40 contains explosive weighing more than 22.7 grams. The completed charge 10 includes two outer support plates 48, each having an annular base 50 from which an annular neck 52 extends. The completed charge 10 also includes two inner support plates 54. When the plates are assembled as shown in the drawing, they define central cavities 56 for receiving the pellets of explosive which were packaged in individual packages wherein the explosive material weighed less than 22.7 grams. These packages are unpacked at the field location and the explosive pellets are consolidated within the volumes defined by the plates 48, 54. The pellets are identified in the drawing by the reference numeral 58. These are preferably pellets of $C_4$ material (a plasticized RDX explosive).

The aforementioned components of the tool 2 are used in implementing the preferred embodiment of the method of the present invention. This method of cutting an object in a well comprises transporting a first explosive to a field location in individual quantities which are less than a predetermined limit quantity. Specifically, this includes transporting pellets 58 of $C_4$ explosive in individual packages wherein the quantity of $C_4$ is less than 22.7 grams so that the packages can be shipped as class C materials.

The method also comprises transporting a second explosive to the field location in a quantity less than the predetermined limit quantity, which second explosive is a more sensitive explosive than the first explosive. Specifically, this includes transporting the RDX booster pellet 8 to the field location as a separate package wherein the RDX weighs less than 22.7 grams, again allowing this package to be transported as class C material. The RDX explosive of the booster 8 is more sensitive than the $C_4$ explosive of the shaped charge 10 so that upon detonation, the more sensitive explosive 8 better ignites the less sensitive $C_4$ explosive 58 to provide an improved cutting force.

The method of the preferred embodiment further comprises consolidating, at the field location, the individual quantities of first explosive into a shaped charge having a total quantity of the first explosive greater than the predetermined limit. This includes constructing the shaped charge 10 in a manner readily apparent from the drawing and as described hereinabove.

The method still further comprises assembling the cutting tool 2 at the field location, including supporting the second explosive, namely the booster explosive 8, adjacent the shaped charge 10.

Once assembled, the cutting tool 10 is lowered into the well to the object therein to be cut. Lowering is accomplished by conventional means which would typically include a wire line or other means for igniting the booster fuse 6 to initiate the cutting explosion for which the tool 2 is intended.

Once the cutting tool 2 has been lowered into the well to the appropriate location, the shaped charge is detonated in response to detonating the booster explosive 8 so that the detonated shaped charge 10 generates a force which cuts the object.

Using the above-described cutting tool 2 and methodology, a more effective and reliable cutting force is obtained while also obtaining the transportation advantages brought about by utilizing packages which qualify for class C status. This status typically allows less expensive, more expedient, safer transportation.

Thus, the present invention is well adapted to carry out the objects and attain the ends and advantages mentioned hereinabove as well as those inherent therein. While a preferred embodiment of the invention has been described for the purpose of this disclosure, changes in the arrangement and construction of parts and the performance of steps can be made by those skilled in the art, which changes are encompassed within the spirit of this invention as defined by the appended claims.

What is claimed is:

1. A method of cutting an object in a well, comprising:

transporting a first explosive to a field location in individual quantities which are less than a predetermined limit quantity;

transporting a second explosive to the field location in a quantity less than the predetermined limit quantity, which second explosive is a more sensitive explosive than the first explosive;

consolidating, at the field location, the individual quantities of first explosive into a shaped charge having a total quantity of the first explosive greater than the predetermined limit;

assembling a cutting tool at the field location, including supporting the second explosive adjacent the shaped charge;

lowering the cutting tool into the well to an object therein to be cut; and detonating the shaped charge in response to detonating the second explosive so that the detonated shaped charge generates a force which cuts the object.

2. A method as defined in claim 1, wherein the individual quantities of first explosive include pellets of plasticized RDX, and the second explosive includes an RDX booster.

3. A method of cutting a tubular element in a well, comprising:

packaging pellets of $C_4$ explosive into packages, each of which packages contains less than 22.7 grams of the $C_4$ explosive, and transporting the packages to a field location;

transporting a pellet of RDX explosive to the field location, which pellet of RDX weighs less than 22.7 grams;

consolidating, at the field location, pellets of $C_4$ explosive from the packages into an annular shaped charge;

assembling a cutting tool at the field location, including supporting the pellet of RDX explosive concentrically within the annular shaped charge;

lowering the cutting tool into the well to the location where a pipe in the well is to be cut; and detonating the annular shaped charge of $C_4$ explosive in response to detonating the pellet of RDX explosive so that a force is generated and exerted radially outwardly from the annular shaped charge to cut the tubular member.

4. A method of cutting a tubular member in a wellbore comprising:

identifying the location of said wellbore containing said tubular member;

transporting to said location the various elements of an explosive cutting tool said elements at least including a low detonation sensitive charge explosive in the form of discrete pellets and a booster explosive having a detonation sensitivity greater than said charge explosive;

assembling at said location said elements to thereby produce said explosive cutting tool;

introducing said cutting tool into said tubular member; and detonating said charge explosive to thereby cut said tubular member;

wherein said booster explosive and said pellets are transported to said location in separate quantities, with the weight of each of such separate quantities being less than a predetermined explosive weight limit and further wherein during said assembling step said quantities of pellets are consolidated into said explosive cutting tool in a detontable mass having a weight greater than said predetermined explosive weight limit and said booster explosive is placed into said explosive cutting tool in detonating contact with said charge explosive.

5. The method of claim 4 wherein said low detonation sensitive charge explosive is plasticized RDX and said booster explosive is RDX.

6. The method of claim 5 wherein said predetermined explosive weigh limit is 22.7 grams.

7. An explosive cutting tool (2) for severing a tubular member in a wellbore comprising:

a support body (4) comprising a cylindrical sleeve (12), a lower cylindrical end piece (14) and an upper cylindrical end piece (16);

A shaped charge container (10) maintained within said support body (4) comprising a lower outer support plate (50) housed within said cylindrical sleeve (12) adjacent said lower cylindrical end piece (14), said lower outer support plate (50) having a first perpendicular neck (52) extending axially within said support body (4) toward said upper cylindrical end piece (16), an upper outer support plate (50) housed within said cylindrical sleeve (12) adjacent said upper cylindrical end piece (16) said upper outer support plate (50) having a second perpendicular neck (52) extending axially within said support body (4) toward said lower cylindrical end piece (14), a lower inner support plate (54) cooperating with said lower outer support plate (5) to form a lower frusto-conical half (40) axially aligned with said body (4) and an upper inner support plate (54) cooperating with said upper outer support plate (50) to form an upper frusto-conical half (40) axially aligned with said body (4) wherein said upper and lower frusto-conical halves (40) cooperate to define an annular circumferntial groove (46) having a V-shaped cross section;

a first central cavity (56) in said lower frusto-conical half (40), said first cavity (56) being the volume defined by said lower outer support plate (50), said lower inner support plate (54) and said first perpendicular neck (52);

a second central cavity (56) in said upper frusto-conical half (40), said second cavity (56) being the volume defined by said upper outer support plate (50), said upper inner support plate (54) and said second perpendicular neck (52);

a third central cavity lying between said first perpendicular neck (52) and said second perpendicular neck (52) and in direct communication with said first central cavity (56) and said second central cavity (56);

wherein said explosive cutting tool (2) is adapted to permit, at a field location subsequent to any required transportation to said field location: the consolidation into each one of said first central cavity (56) and said second central cavity (56) of a plurality of pellets (58) of a low detonation sensitive charge explosive to form detonatable masses; the introduction into said third central cavity in detonating contact with said charge explosive of a booster explosive (8) having a detonation sensitivity greater than said charge explosive; and the introduction into said third central cavity of a booster fuse (6) penetrating and in detonating contact with said booster explosive (8).

8. The explosive cutting tool of claim 7 wherein said low detonation sensitive charge explosive is plasticized RDX and said booster explosive is RDX.

* * * * *